US009421759B1

(12) United States Patent
Mongeon et al.

(10) Patent No.: US 9,421,759 B1
(45) Date of Patent: Aug. 23, 2016

(54) SYSTEM AND METHOD FOR IDENTIFICATION OF SPARSE PATTERNS IN IMAGE DATA USING DISJOINT TEMPLATE MATCHING

(71) Applicant: Xerox Corporation, Norwalk, CT (US)

(72) Inventors: Michael C. Mongeon, Walworth, NY (US); Howard A. Mizes, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/686,401

(22) Filed: Apr. 14, 2015

(51) Int. Cl.

| | |
|---|---|
| ***B41J 2/045*** | (2006.01) |
| ***B41J 2/21*** | (2006.01) |
| ***B41J 25/00*** | (2006.01) |
| ***B41J 19/14*** | (2006.01) |

(52) U.S. Cl.
CPC ..... *B41J 2/04505* (2013.01); *B41J 2/2135* (2013.01); *B41J 19/145* (2013.01); *B41J 25/001* (2013.01)

(58) Field of Classification Search
None
See application file for complete search history.

(56) References Cited

U.S. PATENT DOCUMENTS

| | | | |
|---|---|---|---|
| 6,738,517 | B2 | 5/2004 | Loce et al. |
| 6,993,156 | B1 | 1/2006 | Szeliski et al. |
| 7,711,143 | B2 | 5/2010 | Rhoads |
| 8,005,254 | B2 | 8/2011 | Rhoads |
| 8,401,294 | B1 | 3/2013 | Allen |
| 8,651,615 | B2 | 2/2014 | Elliot et al. |
| 2003/0031367 | A1 | 2/2003 | Schwartz |
| 2003/0161534 | A1 | 8/2003 | Loce et al. |
| 2008/0150995 | A1* | 6/2008 | Srinivasan et al. ..... 347/19 |
| 2012/0230586 | A1 | 9/2012 | Blennerhassett |
| 2014/0093160 | A1 | 4/2014 | Porikli et al. |

OTHER PUBLICATIONS

Fredriksson et al.; Sequential and indexed two-dimensional combinatorial template matching allowing rotations; Theoretical Computer Science; Jun. 29, 2005; pp. 239-275; Elsevier, www.elsevier.com/locate/tcs.

CV Reference Manual; OpenCV: Image Processing and Computer Vision Reference Manual; Mar. 25, 2015; 65 Pages; http://www.seas.upenn.edu/~bensapp/opencvdocs/ref/opencvref_cv.htm#decl_cvMatchTemplate.

Heber et al.; Efficient Template Matching; Mar. 26, 2015; 2 Pages; https://rvlab.icg.tugraz.at/project_page/project_efficient_ncc/project_efficient_ncc.htm.

Clifford et al.; Self-normalised distance with don't cares; 21 Pages.; University of Bristol, UK.

Violeta N. Chang Camacho; Searching in Compressed Image Databases;12 Pages; University of Chile, Santiago, Chile.

* cited by examiner

*Primary Examiner* — Justin Seo

(74) *Attorney, Agent, or Firm* — Maginot Moore & Beck LLP

(57) ABSTRACT

A method uses a sparse test pattern to identify a spatial relationship between a printhead and an image receiving surface in a printer. The method includes operating a plurality of ejectors in the printhead to form a printed marks on the image receiving surface, generating image data of the test pattern, and applying a predetermined disjoint template to the image data to identify a location of the printed marks. The disjoint template matching process improves the accuracy of identifying the printed marks in noisy image data and for sparse test patterns.

22 Claims, 6 Drawing Sheets

SYSTEM AND METHOD FOR IDENTIFICATION OF SPARSE PATTERNS IN IMAGE DATA USING DISJOINT TEMPLATE MATCHING

TECHNICAL FIELD

This disclosure is directed to pattern identification in image data and, more particularly, to systems and methods of identifying patterns of marks in noisy image data.

BACKGROUND

Many printer and additive manufacturing embodiments use printed test patterns to perform marking device alignment and registration processes during operation. As used herein, the term "test pattern" refers to a predetermined arrangement of marks that are formed by depositing printing material from one or more marking devices on an image receiving surface. A printer receives digital image data that correspond to the test pattern and selectively deposits marking material on an image receiving surface. When the marking device is an inkjet, the selective deposition is performed by operating a portion of the ejectors in the printheads to form the printed test pattern on an image receiving surface, such as a paper print medium or an indirect support member that receives the marking agent. The marks in the test pattern are separated from each other to enable an optical sensor to generate scanned image data of the printed test pattern. A controller in the printer processes the printed marks in the scanned image data to, for example, identify the location of a marking device in the print zone and identify relative registration errors between multiple marking devices. The registration errors can negatively impact the quality of printed documents and manufactured parts, and some printer embodiments identify and correct the registration errors during a job to maintain the visual quality of printed documents and the functionality of printed parts.

As used herein, the term "disjoint test pattern" refers to a test pattern that a printer forms where multiple marks separated from each other are created from a single marking device. Typically, the marks formed are a small percentage of the total marks that a particular marking device can make. The particular arrangement of marks in the disjoint test pattern created from each marking device differs from any of the other marking devices.

As used herein, the term "sparse test pattern" refers to a disjoint test pattern that a printer forms in a configuration that is difficult for human viewers to perceive. For example, traditional test patterns include comparatively large marks that each ejector in a printhead forms from several drops of a marking agent, such as ink. The test patterns are arranged in a regular series of rows that are easily visible to an optical sensor and to an average human observer. In some printer embodiments, a sparse test pattern is formed in margins, which are also referred to as "inter document zone" between printed pages during a multi-page print job. A sparse test pattern, however, includes marks that are formed from a smaller number of drops of the marking agent, and often from only a single drop. Additionally, the sparse test patterns include marks that are formed with an irregular pattern that reduces or eliminates the visibility of the sparse test pattern to a human observer.

One drawback to using disjoint test patterns during operations in the printer is that the contrast between the ink and the media may be small and thus it becomes difficult to sense the location of the individual marks created with the disjoint test pattern. One drawback to using sparse test patterns during operations in the printer is that the reduced visibility of the sparse test pattern also makes identification of the individual printed marks in the test pattern more difficult for a controller in the printer. While optical sensors can generate image data with sufficient quality to resolve printed marks in a sparse test pattern, under some conditions, small artifacts on the image receiving surface, such as paper fibers or contaminants, produce visual noise that can appear similar to the printed marks in the sparse test pattern. For these cases, the controller incorrectly identifies an artifact in the noisy image data as one of the marks in the test pattern, which reduces the accuracy of the printhead registration process. Consequently, improved systems and methods for identifying disjoint test patterns during printhead registration operations would be beneficial.

SUMMARY

In one embodiment, a method of operating a printer to identify the spatial relationship between one or more marking devices and an image receiving surface has been developed. The method includes operating with a controller a first marking device to form a first plurality of marks in a test pattern on an image receiving surface, operating with the controller a second marking device to form a second plurality of marks in the test pattern on the image receiving surface, generating with an optical sensor image data of the test pattern formed on the image receiving surface, retrieving with the controller a first disjoint template corresponding to an arrangement of the first plurality of marks in the test pattern from a memory, identifying with the controller a location of the first disjoint template in alignment with only the first plurality of marks in the image data and not with the second plurality of marks in the image data, and identifying with the controller a spatial relationship between the first marking device and the image receiving surface with reference to the location of the first disjoint template in the image data.

In another embodiment, an inkjet printer that is configured to identify the spatial relationship between one or more printheads and an image receiving surface has been developed. The inkjet printer includes a first printhead including a first plurality of ejectors configured to eject drops of a marking agent onto an image receiving surface in a print zone, a second printhead including a second plurality of ejectors configured to eject drops of the marking agent onto the image receiving surface in the print zone, an optical sensor configured to generate image data of the image receiving surface in the print zone, and a controller operatively connected to the first printhead, the second printhead, the optical sensor, and a memory. The controller is configured to operate the first plurality of ejectors in the first printhead to form a first plurality of marks in a test pattern on an image receiving surface, operate the second plurality of ejectors in the second device to form a second plurality of marks in the test pattern on the image receiving surface, generate with the optical sensor image data of the test pattern formed on the image receiving surface, retrieve a first disjoint template corresponding to an arrangement of the first plurality of marks in the test pattern from the memory, identify a location of the first disjoint template in alignment with only the first plurality of marks in the image data and not with the second plurality of marks in the image data, and identify a spatial relationship between the first marking device and the image receiving surface with reference to the location of the first disjoint template in the image data.

BRIEF DESCRIPTION OF THE DRAWINGS

The foregoing aspects and other features of a system and method for identification of patterns in image data and identification of a spatial relationship between one or more marking devices and an image receiving surface are explained in the following description, taken in connection with the accompanying drawings.

DETAILED DESCRIPTION

Figure 1:
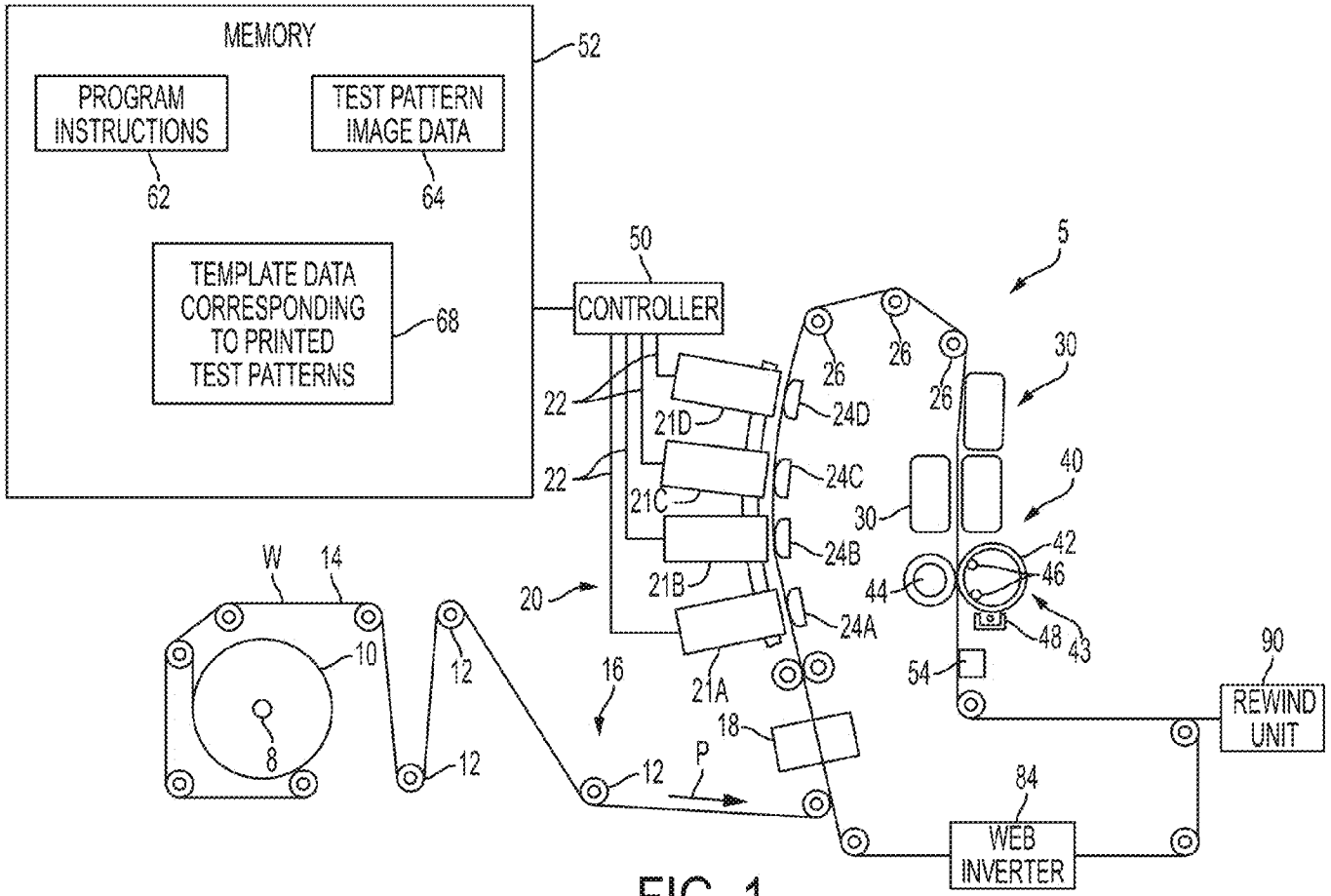
FIG. 1 is a schematic diagram of an inkjet printer that uses template matching to identify the locations of printheads in a print zone from a predetermined test pattern.

For a general understanding of the environment for the device disclosed herein as well as the details for the device, reference is made to the drawings. In the drawings, like reference numerals designate like elements.

As used herein, the word "printer" encompasses any apparatus that produces images with colorants on media or parts with a combination of build material, support material and colorants, such as digital copiers, bookmaking machines, facsimile machines, multi-function machines, three-dimensional printers, and the like. As used herein, the term "process direction" refers to a direction of relative movement of a marking device relative to an image receiving surface. In a printer producing images, the image receiving surface may be a continuous media web pulled from a roll of paper or other suitable print medium along a media path through a printer. A media transport in the printer uses one or more actuators, such as electric motors, to move the print medium past one or more printheads in the print zone to receive ink images and passes other printer components, such as heaters, fusers, pressure rollers, and on-sheet optical imaging sensors, that are arranged along the media path. In a three-dimensional object printer, the image receiving surface may be a plate that receives a base layer of material in the three-dimensional printed object or the upper surface of the partially completed three-dimensional object during the printing process. As used herein, the term "cross-process" direction refers to an axis that is perpendicular to the process direction along the surface of the print image receiving surface.

As used herein, the term "template" refers to a two-dimensional arrange of image data pixels that corresponds to the shape of a predetermined arrangement of pixels in scanned image data corresponding to printed marks that form a portion of a printed test pattern. For example, in one embodiment a printed test pattern includes a plurality of marks from a direct marking printhead that includes 880 ejectors. Only a portion of the ejector from the printhead form marks in the printed test pattern. The template includes a two-dimensional arrangement of image data that include pixel locations corresponding to locations in the cross-process and process directions where a portion of the ejectors in the printhead form printed marks on the image receiving surface. Only a portion of the pixels in the template correspond to locations of printed marks in the test pattern.

As used herein, the term "disjoint template" refers to a plurality of two-dimensional arrangements of image data pixels or templates that corresponds to a predetermined arrangement of pixels in scanned image data corresponding to a plurality of printed marks that are emitted from a single marking device that form a portion of a printed test pattern. The locations of the sets of pixels of the disjoint template correspond to the expected locations of the printed marks in the scanned image data when a controller aligns the disjoint template with the location of the disjoint printed marks in a larger set of scanned image data. For example, the disjoint template includes groups of arrays of pixels that correspond to the expected cross-process direction distance between separated marks one of the printheads forms in the test pattern, the arrangement of process direction offsets for the marks in the test pattern, the size of each printed mark, and the scale and resolution of the scanned image data. As described below, a controller performs either an exhaustive or sparse template matching process to identify a location in the scanned image data that corresponds to the locations of disjoint test pattern marks within the disjoint template image data.

As used herein, the term "marking device" refers to a component of a printer that controls the locations of marking agent deposition onto a surface of a print medium. For example, a printhead in an inkjet printer is a marking device that ejects drops of an ink marking agent onto a print medium or an indirect image receiving member such as a drum or belt. Many inkjet printers include arrays of two or more printheads for multi-color printing or to enable high speed printing over a print medium. Some three-dimensional object printers also employ inkjet printhead marking devices that eject drops of build materials, support materials, and one or more ink colors in a series of layers that form three-dimensional printed objects. Other printer embodiments include xerographic printers that use a light source, such as a laser, as a marking device to remove an electrostatic charge from an imaging member, such as a rotating drum or belt, in selected patterns. One or more toner development subsystems in the xerographic printer emit toner particles that are attracted to the portions of the imaging member that are exposed to the light sources to form first and second pluralities of marks of the toner marking agent in a test pattern. Some xerographic printer embodiments include multiple light source marking devices that control the electrical charge on the imaging member. Still other examples of marking devices include arrays of light emitting diodes (LEDs) in LED printers and arrays of heating elements in thermal printers.

FIG. 1 is a simplified schematic view of the direct-to-sheet, continuous-media, phase-change inkjet printer 5, that is configured to generate test patterns using a plurality of printheads positioned in a print zone in the printer. A media supply and handling system is configured to supply a long (i.e., substantially continuous) web of media 14 of "substrate" (paper, plastic, or other printable material) from a media source, such as a spool of media 10 mounted on a web roller 8. For simplex printing, the printer includes the web roller 8, media conditioner 16, print zone or printing station 20, and rewind unit 90. For duplex operations, the web inverter 84 flips the web to present a second side of the media to the printing station 20 before the rewind unit 90 winds the web 14 into a roll for post-printing finishing. In the simplex operation, the media source 10 has a width that substantially covers the width of the rollers 12 and 26 over which the media travels through the printer. In duplex operation, the media source has a width that is approximately one-half of the width of the rollers. Thus, the web can travel over about one-half of the length of the rollers in the printing station 20 before being flipped by the inverter 84 and laterally displaced by a distance that enables the web to travel over the other half of the length of the rollers in the printing station 20. The rewind unit 90 is configured to wind the web onto a roller for removal from the printer and subsequent processing.

The media can be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. In alternative embodiments, the media can be transported along the path in cut sheet form in which case the media supply and handling system can include any suitable device or structure that enables the transport of cut media sheets along an expected path through the imaging device. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

The media are transported through a printing station 20 that includes a series of color units 21A, 21B, 21C, and 21D, each color unit effectively extending across the width of the media and being able to place a marking agent directly (i.e., without use of an intermediate or offset member) onto the moving media. The controller 50 is operatively connected to the color units 21A-21D through control lines 22. Each of the color units 21A-21D includes a plurality of printheads positioned in a staggered arrangement in the cross-process direction over the media web 14. As is generally familiar, each of the printheads can eject a single color of ink, one for each of the colors typically used in four color printing, namely, cyan, magenta, yellow, and black (CMYK). The controller 50 of the printer receives velocity data from encoders mounted proximately to rollers positioned on either side of the portion of the path opposite the four printheads to compute the position of the web as moves past the printheads. The controller 50 uses these data to generate timing signals for actuating the inkjets in the printheads to enable the four colors to be ejected with a reliable degree of accuracy for registration of the differently color patterns to form four primary-color images on the media. The inkjets actuated by the firing signals correspond to image data processed by the controller 50. The image data can be transmitted to the printer, generated by a scanner (not shown) that is a component of the printer, or otherwise electronically or optically generated and delivered to the printer. In various alternative embodiments, the printer 5 includes a different number of color units and can print inks having colors other than CMYK.

In the illustrative embodiment of FIG. 1, the printer 5 uses four different colors of "phase-change ink," by which is meant that the ink is substantially solid at room temperature and substantially liquid when heated to a phase change ink melting temperature for jetting onto the imaging receiving surface. Alternative printer embodiments use a single color of ink or a different number of ink colors. The phase change ink melting temperature can be any temperature that is capable of melting solid phase change ink into liquid or molten form. In one embodiment, the phase change ink melting temperature is approximately 70° C. to 140° C. In alternative embodiments, the ink utilized in the imaging device can comprise UV curable gel ink. Gel ink can also be heated before being ejected by the inkjets of the printhead. Alternative embodiments of the printer 5 use aqueous inks that are liquid at room temperature. As used herein, liquid ink refers to melted solid ink, heated gel ink, or other known forms of ink, such as aqueous inks, ink emulsions, ink suspensions, ink solutions, or the like.

The printheads in the printer 5 eject drops of ink to form printed images that are visible on the surface of the media web 14 and to form sparse test patterns that are visible to the optical sensor 54 in the inter-document zones between printed pages. The ink used in the printer 5 is an example of a "marking agent". As used herein, the term "marking agent" refers to any material that is ejected from the printheads in a printer onto an image receiving surface for either traditional two-dimensional printing or in three-dimensional object printing. For example, high-contrast inks such as CMYK inks that are ejected onto a paper print medium or an indirect image receiving member are common examples of marking agents that are used in traditional document printing applications. In three-dimensional object printers, the marking agent may be a build material that the printheads eject in a series of layers to form a three-dimensional object. Some forms of build material are also exhibit high optical contrast with an image receiving surface, while other forms of build material are lower-contrast materials that are more difficult to detect in scanned image data. As described below, a template matching process improves the accuracy of identifying printed marks that are formed from a wide range of marking agents, including sparse test patterns that are formed from the high-contrast inks and sparse or non-sparse test patterns that are formed from lower-contrast marking agents such as build materials that are used in three-dimensional object printers.

Associated with each of color units 21A-21D is a corresponding backing member 24A-24D, respectively. The backing members 24A-24D are typically in the form of a bar or roll, which is arranged substantially opposite the printhead on the back side of the media. Each backing member is used to position the media at a predetermined distance from the printhead opposite the backing member. In the embodiment of FIG. 1, each backing member includes a heater that emits thermal energy to heat the media to a predetermined temperature which, in one practical embodiment, is in a range of about 40° C. to about 60° C. The various backer members can be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media web 14 moves to receive inks of various colors from the printheads of the print zone 20, the printer 5 maintains the temperature of the media web within a given range. The printheads in the color units 21A-21D eject ink at a temperature typically significantly higher than the temperature of the media web 14. Consequently, the ink heats the media. Therefore, other temperature regulating devices may be employed to maintain the media temperature within a predetermined range. For example, the air temperature and air flow rate behind and in front of the media may also impact the media temperature. Accordingly, air blowers or fans can be utilized to facilitate control of the media temperature. Thus, the printer 5 maintains the temperature of the media web 14 within an appropriate range for the jetting of all inks from the printheads of the print zone 20. Temperature sensors (not shown) can be positioned along this portion of the media path to enable regulation of the media temperature.

Following the print zone 20 along the media path, the media web 14 moves over guide rollers 26 to one or more "mid-heaters" 30. A mid-heater 30 can use contact, radiant, conductive, and/or convective heat to control a temperature of the media. Depending on the temperature of ink and paper at rollers 26, this "mid-heater" can add or remove heat from the paper and/or ink. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 applies heat and/or pressure to the media to fix the images to the media. The fixing assembly 40 includes any suitable device or apparatus for fixing images to the media including heated or unheated pressure rollers, radiant heaters, heat lamps, and the like. In the embodiment of FIG. 1, the fixing assembly includes a "spreader" 43, that applies a predetermined pressure, and in some implementations, heat, to the media. The function of the spreader 40 is to take what are essentially droplets, strings of droplets, or lines of ink on web 14 and smear them out by pressure and, in some systems, heat, so that spaces between adjacent drops are filled and image solids become uniform. In addition to spreading the ink, the spreader 40 also improves image permanence by increasing ink layer cohesion and/or increasing the ink-web adhesion. The spreader 43 includes rollers, such as image-side roller 42 and pressure roller 44, to apply heat and pressure to the media. Either roll can include heat elements, such as heating elements 46, to bring the web 14 to a temperature in a range from about 35° C. to about 80° C. In alternative embodiments, the fixing assembly can be configured to spread the ink using non-contact heating (without pressure) of the media after the print zone. Such a non-contact fixing assembly uses any suitable type of heater to heat the media to a desired temperature, such as a radiant heater, UV heating lamps, and the like. In another printer embodiment that employs aqueous ink, the fixing assembly 40 does not include a spreader, such as the spreader 40, but includes one or more heaters that dry aqueous ink on the media web after the media web passes through the print zone 20. In a UV ink printer embodiment, the fixing assembly 40 includes UV light sources that direct UV radiation at the ink to cross-link and fix the ink to the surface of the media web.

In one practical embodiment, the roller temperature in spreader 40 is maintained at an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi lbs/side.

The spreader 40 also includes a cleaning/oiling station 48 associated with image-side roller 42. The station 48 cleans and/or applies a layer of some release agent or other material to the roller surface. In the printer 5, the release agent material is an amino silicone oil having viscosity of about 10-200 centipoises. Only small amounts of oil are required and the oil carried by the media is only about 1-10 mg per A4 size page. In one possible embodiment, the mid-heater 30 and spreader 40 can be combined into a single unit, with their respective functions occurring relative to the same portion of media simultaneously. In another embodiment the media is maintained at a high temperature during the printing operation to enable the spreader 40 to spread the ink while the ink is in a liquid or semi-liquid state.

Following passage through the spreader 40 the printed media can be wound onto a roller for removal from the system (simplex printing) or directed to the web inverter 84 for inversion and displacement to another section of the rollers for a second pass by the printheads, mid-heaters, and spreader. The duplex printed material is subsequently wound onto a roller for removal from the system by rewind unit 90. Alternatively, additional processing stations receive the print medium and perform tasks such as cutting, binding, collating, and/or stapling the media or the like.

Operation and control of the various subsystems, components and functions of the printer 5 are performed with the aid of the controller 50. The controller 50 is implemented with general or specialized programmable processors that execute programmed instructions. The instructions and data required to perform the programmed functions are stored in a memory 52 that is operatively connected to the controller 50. The memory 52 includes volatile data storage devices such as random access memory (RAM) and non-volatile data storage devices including magnetic and optical disks or solid state storage devices. The processors, their memories, and interface circuitry configure the controllers and/or print engine to perform the functions, such as the difference minimization function, described above. These components are provided on a printed circuit card or provided as a circuit in an application specific integrated circuit (ASIC). In one embodiment, each of the circuits is implemented with a separate processor device. Alternatively, the circuits can be implemented with discrete components or circuits provided in VLSI circuits. Also, the circuits described herein can be implemented with a combination of processors, ASICs, discrete components, or VLSI circuits.

As described in more detail below, the controller 50 executes stored program instructions 62 in the memory 52 to form printed patterns on the media web 14 with reference to predetermined test pattern image data 64. The controller 50 identifies a spatial relationship between one or more of the printheads in the color units 21A-21D and the image receiving surface of the media web 14 based on scanned image data of the printed test patterns and a plurality of templates 68. Each template 68 is a set of two-dimensional image data that corresponds to the expected marks in the test pattern that are formed by the ejectors in one printhead in the color units 21A-21D. The controller 50 applies the disjoint template for one printhead to the scanned image data to identify the location of the printhead based on the location of the entire printed pattern of marks that the printhead forms on the media web 14. As described below, the controller 50 employs the disjoint template matching process to improve the accuracy of identifying the location of printed marks in sparse test patterns and in the presence of visual noise on the image receiving surface.

The printer 5 includes an optical sensor 54 that is configured to generate image data corresponding to the media web 14 and printed test patterns formed on the media web 14. The optical sensor is configured to generate signals indicative of reflectance levels of the media, ink, or backer roll opposite the sensor to enable detection of, for example, the presence and/or location of ink drops jetted onto the receiving member by the inkjets of the printhead assembly. The optical sensor 54 includes an array of optical detectors mounted to a bar or other longitudinal structure that extends across the width of an imaging area on the image receiving member.

In one embodiment, the imaging area is approximately twenty inches wide in the cross-process direction and the printheads print at a resolution of 600 dpi in the cross-process direction. In this embodiment, over 12,000 optical detectors are arrayed in a single row along the bar to generate a single scanline of image data corresponding to a line across the image receiving member. The optical detectors are configured in association in one or more light sources that direct light towards the surface of the image receiving member. The optical detectors receive the light generated by the light sources after the light is reflected from the image receiving member, such as the media web 14. The magnitude of the electrical signal generated by an optical detector corresponds to the amount of light reflected into the detector from the surface of the media web 14, including bare portions of the media web surface and portions that carry printed ink patterns. The magnitudes of the electrical signals generated by the optical detectors are converted to digital values by an appropriate analog/digital converter.

Figure 2:
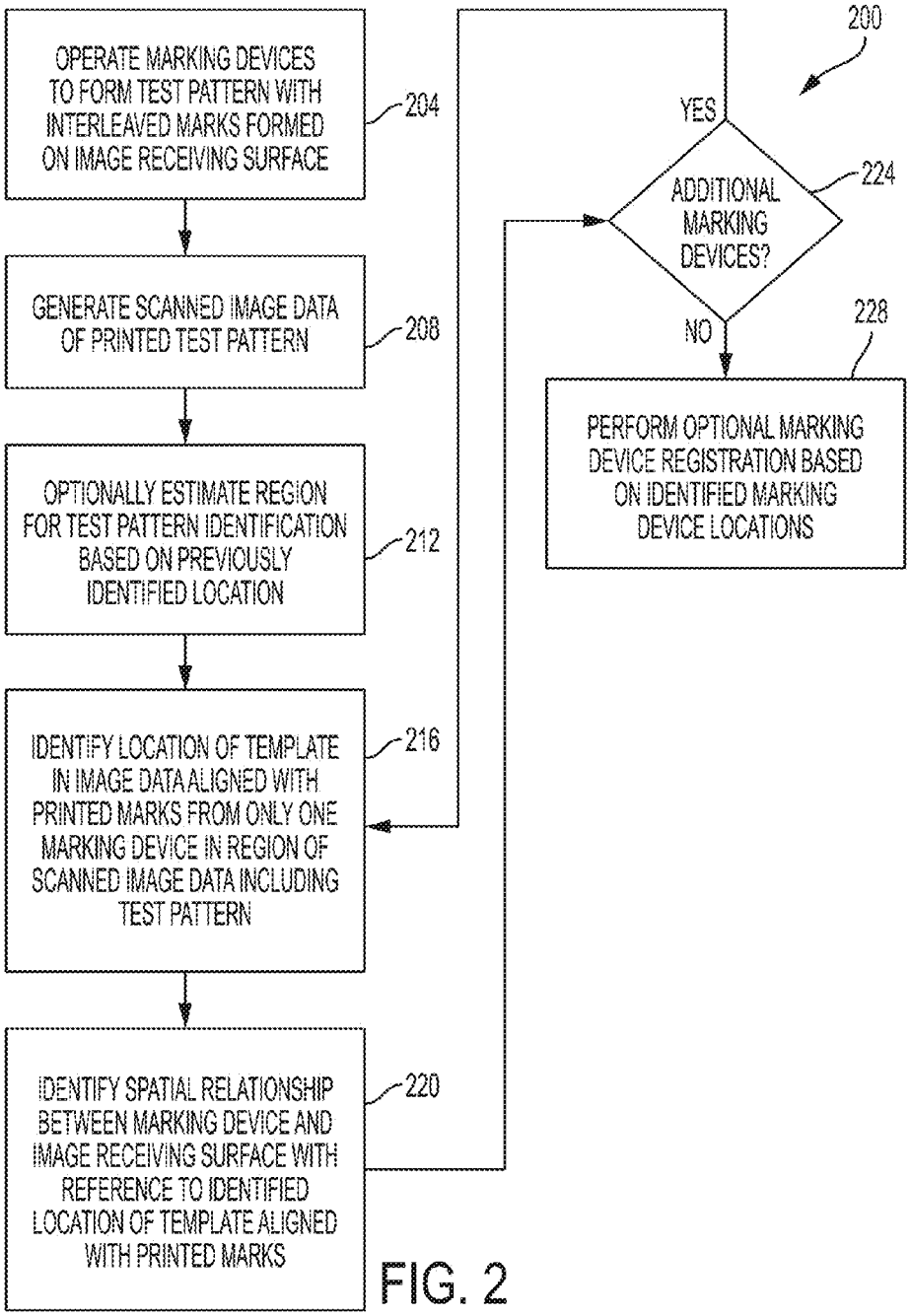
FIG. 2 is a block diagram of a process for forming printed test patterns and identifying the printed test patterns in scanned image data to identify the locations of marking devices in a printer.

FIG. 2 depicts a process 200 for the identification of relative printhead locations in an inkjet printer using disjoint template matching. In the discussion below, a reference to the process 200 performing a function or action refers to the execution of stored program instructions by a controller in a printer to perform the function or action in association with other components in the printer. Process 200 is described in conjunction with the printer 5 of FIG. 1 for illustrative purposes.

Process 200 begins with the operation of the printhead ejectors in the print zone 20 to form a printed test pattern with interleaved marks on an image receiving surface (block 204). In the printer 5, the controller 50 retrieves the disjoint test pattern image data 64 from the memory 52 and operates the printheads in the color units 21A-21D to form the printed test pattern. During process 200, the controller 50 only activates a portion of the ejectors in each printhead to form a plurality of marks in the disjoint test pattern. For example, in one configuration the controller 50 only operates one out of every eight ejectors in a printhead to form a portion of the marks in the printed test pattern. In some embodiments, the controller 50 operates a portion of the ejectors in the printhead that are separated from each other by a predetermined distance in the cross-process direction to produce marks in the printed test pattern that are uniformly separated from each other in cross-process direction. In other embodiments, the controller 50 operates a set of inkjets that form marks at irregular intervals along the cross-process direction based on predetermined test pattern image data that arrange mark locations at the irregular intervals. In still other embodiments, the controller 50 operates groups of inkjets that are located near each other in the printhead to form clusters of marks that are distributed along the cross-process direction. The clustered marks are used, for example, with low contrast marking agents such as transparent inks or build materials in a three-dimensional object printer that are more difficult to detect in the scanned image data if the printhead only ejects a single drop of the material in each location of the test pattern.

Figure 3:
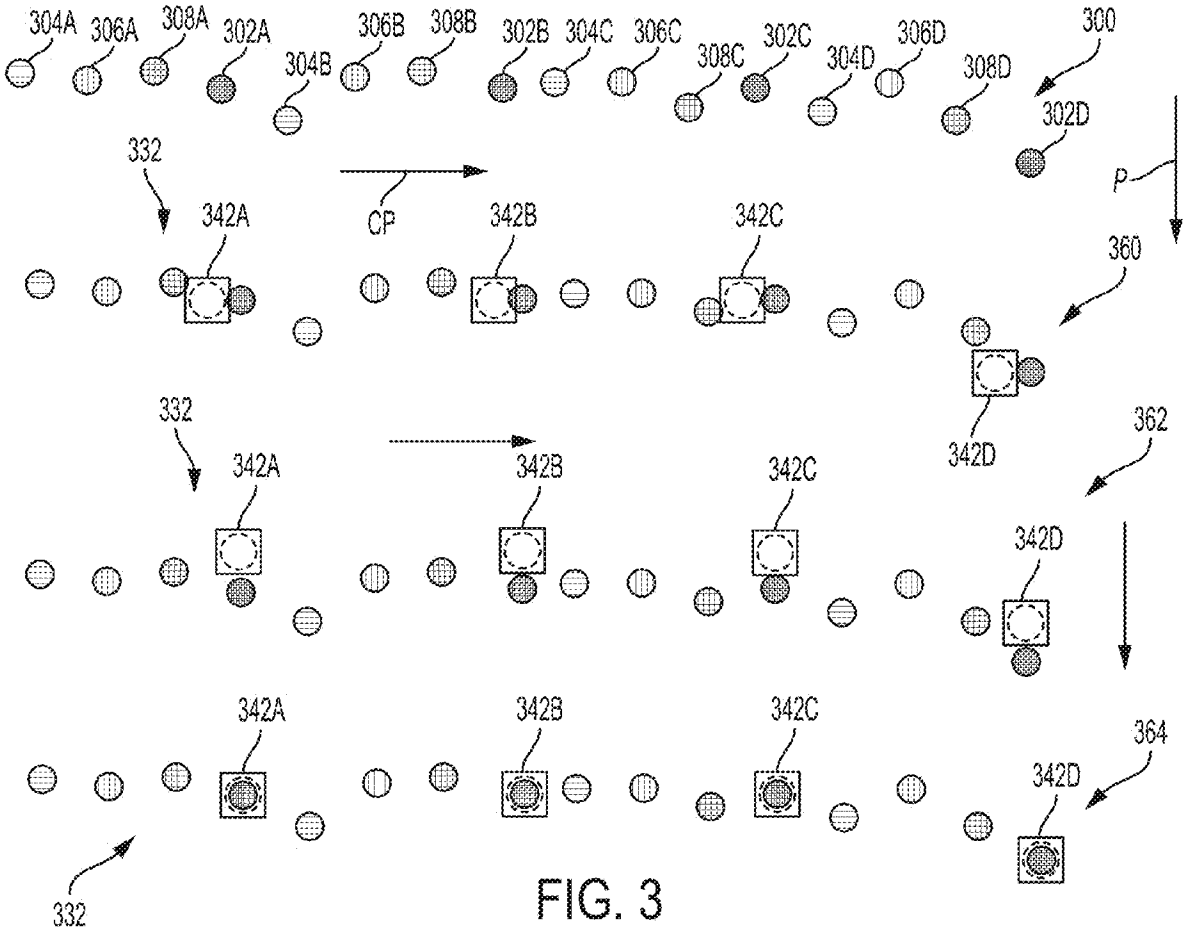
FIG. 3 is a depiction of a sparse test pattern and a template that matches a portion of the marks in the sparse test pattern.
Figure 5:
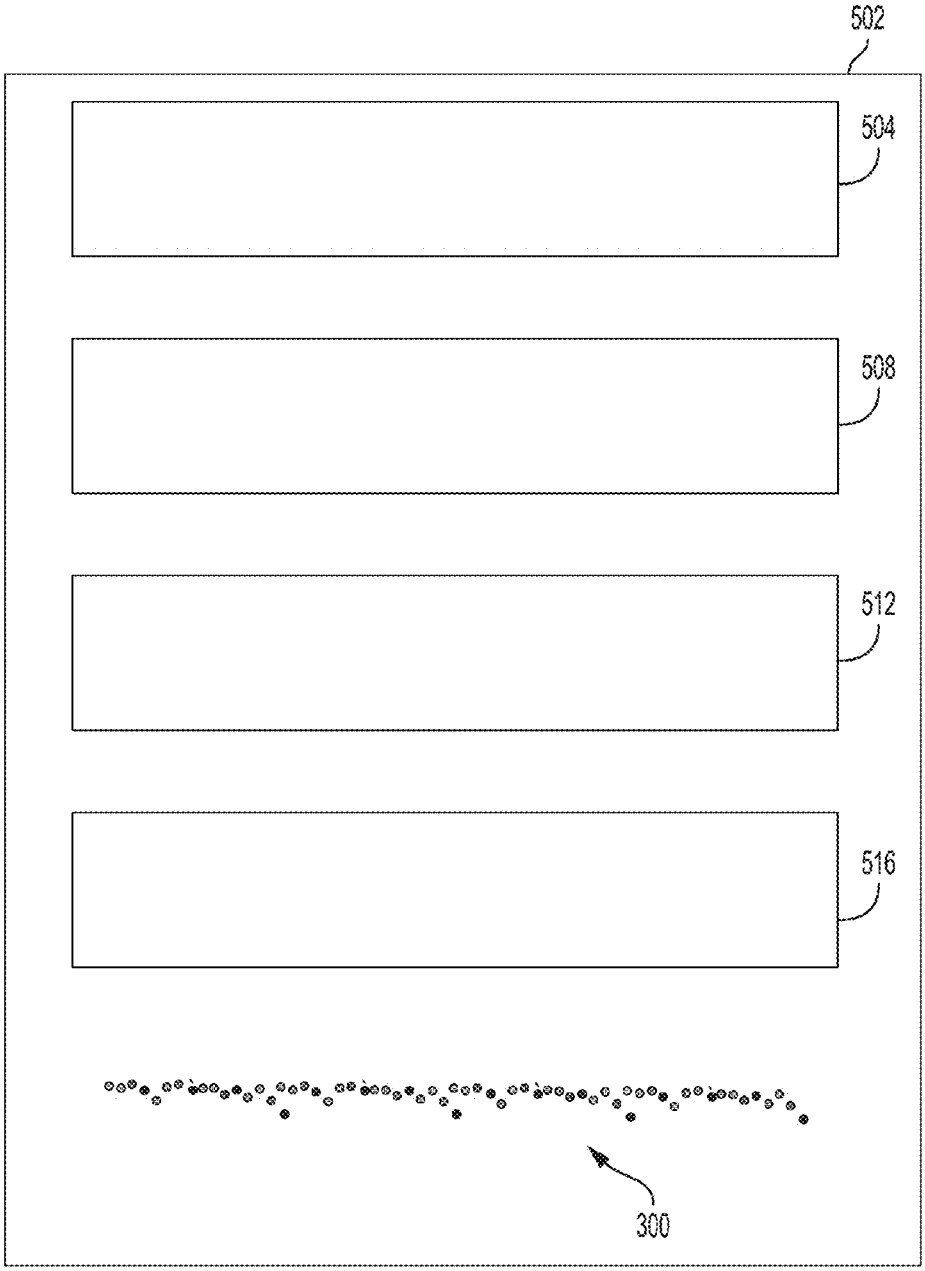
FIG. 5 is a schematic diagram depicting an illustrative configuration of printheads that form different portions of the printed marks in a printed test pattern.

The printer 5 forms a test pattern with an "interleaved" arrangement of marks from different printheads that are aligned with each other along the cross-process direction. As used herein, the term "interleaved" refers to an arrangement of printed marks in a test pattern where at least a portion of the printed marks from one printhead are arranged between printed marks from one or more of the other printheads in the cross-process direction. FIG. 3 depicts a printed test pattern 300 that includes an interleaved arrangement of printed marks from four different printheads. The marks 302A-302D are from a black ink printhead, marks 304A-304D are from a cyan ink printhead, marks 306A-306D are from a magenta ink printhead, and marks 308A-308D are from a yellow ink printhead. As depicted in FIG. 3, the printed marks in the test pattern 300 are arranged in an interleaved pattern with the black ink marks 302A-320D from a first black ink printhead being formed between the cyan marks 304A-304D from a second cyan ink printhead and between marks from the other printheads. FIG. 5 depicts an illustrative arrangement of printheads 504-516 that form an interleaved printed test pattern on an image receiving surface 502 using a portion of the ejectors in each printhead. The printheads 504-516 each correspond to one of the printheads in each of the color units 21A-21D in the print zone 20 of the printer 5, although larger printer embodiments such as the printer 5 include larger arrays of staggered printheads that eject ink drops onto the surface of the media web 14 within the print zone 20. The printheads 504-516 eject ink drops onto a single region of the image receiving surface 502 in the cross-process direction CP. The controller 50 operates a different set of ejectors in each of the printheads 504-516 to form a portion of the marks in the interleaved printed test pattern.

During process 200, the printer 5 forms the printed test pattern with interleaved marks that are formed with uniform spacing in the cross-process direction CP. The image data for the test pattern also include a non-uniform distribution of the printed marks along the process direction P, and the printer 5 forms the plurality of marks in the test pattern with the non-uniform distribution. For example, as depicted in FIG. 3, each set of printed marks 302A-302D, 304A-304D, 306A-306D, and 308A-308D is formed in a non-uniform distribution along the process direction P. The controller 50 produces the offsets in the process direction by operating the ejectors in each printhead at different times with reference to the test pattern image data. Thus, during process 200 the controller 50 operates a portion of the ejectors in each printhead at predetermined times to produce the arrangement of marks with at least one mark being offset in the process direction from at least one other mark in each group of marks. Additionally, the distribution of marks along the process direction P is different for each group of printed marks from the different printheads.

Figure 4:
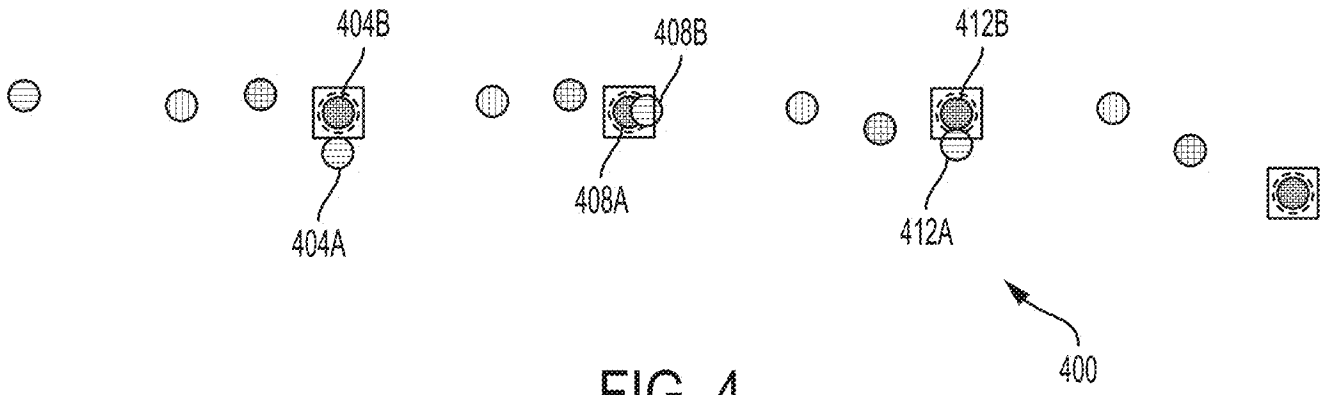
FIG. 4 is a depiction of a printed test pattern with a portion of the marks in the printed test pattern being formed by a printhead that has registration offset.

The non-uniform distribution of the marks in the test pattern along the process direction axis serves at least two purposes. First, a non-uniform distribution is less perceptible to the human eye in comparison to a uniform series of rows in the test pattern. Second, because each set of marks in the test pattern is formed with a different distribution of positions along the process direction axis, the process and cross process direction offset of the marks formed from each printhead can be identified uniquely even if the printheads are misaligned by a comparatively large distance in the process and cross process direction. For example, FIG. 4 depicts a printed test pattern 400 that the printer 5 produces when the cyan printhead is misaligned in the cross-process direction to eject drops of cyan ink onto locations that overlap some of the black ink drops. The image data for the printed test pattern 400 is the same as for the test pattern 300 of FIG. 3, but the misalignment of the cyan printhead produces a different printed pattern. However, because the printer 5 forms the test pattern 400 with different groups of marks from the printheads that have different process direction offsets, the printer 5 still identifies different sets of printed marks correctly using the disjoint templates. For example, as described in more detail below, the printer 5 identifies the correct locations of the black in drops and cyan ink drops using two different templates for each set of marks even though some of the marks, such as the marks 404A/404B, 408A/408B, and 412A/412B are located in close proximity or overlap one another.

Referring again to FIG. 2, process 200 continues as the printer generates scanned image data of the printed test pattern on the image receiving surface (block 208). In the printer 5, the optical sensor 54 generates a series of scanlines of the scanned image data using the array of optical detectors. The controller 50 receives the scanlines to generate a two-dimensional array of pixels that depict the image receiving surface and the printed test pattern. In most configurations, the scanned image data include a larger region of the image receiving surface that incorporates the test pattern and additional regions beyond the test pattern. In some embodiments, the controller 50 also estimates multiple regions of the scanned image data that includes the test pattern based on the previously identified locations of previously printed test patterns and the predetermined velocity of the media web 14 in the process direction (block 212). The estimation process reduces the size of the scanned image data region that the controller 50 processes with templates to identify the sets of printed marks from each of the printheads that forms the printed test pattern, as is described in more detail below.

Process 200 continues as the controller 50 identifies a location of the disjoint template in alignment with the image data where the image data in the disjoint template corresponding to printed marks in the disjoint test pattern have a minimum difference from the corresponding scanned image data for a predetermined arrangement of marks that only one printhead in the print zone forms in the printed test pattern (block 216). The disjoint template is also a union of two-dimensional arrangements of pixels that is similar to the image data but includes a set of pixels that correspond to the expected locations of the printed marks in the scanned image data if the controller 50 aligns the disjoint template with the location of the printed marks.

In one embodiment, the number of pixels in the process direction and the cross process direction for each element of the disjoint template corresponds to the size of each printed mark and the scale and resolution of the scanned image. The number of pixels that separate the elements of the disjoint template corresponds to the expected cross-process direction distance between marks one of the printheads forms in the test pattern and the arrangement of process direction offsets for the marks in the test pattern The size of each mark often corresponds to a single drop of ink in a test pattern but may be larger for lower-contrast marking agents to improve the rate of detection. The controller 50 aligns the disjoint template with the scanned image data is performed using a two dimensional sliding window over a range that covers the expected position of the marks in the scanned image. Each point in the sliding window is only summed over elements of the disjoint template. The memory 52 stores the disjoint template pattern image data 68 with a different template for each printhead in the print zone 20 to enable the controller 50 to identify the alignment locations of each disjoint template with only one arrangement of marks that is formed by one corresponding printhead in the printed test pattern. The different disjoint templates and corresponding arrangements of marks in the test pattern enable the controller 50 to match the disjoint template to the corresponding image data for the plurality of marks from one printhead even though the test pattern includes multiple sets of interleaved marks from different printheads. While FIG. 3 depicts each single-drop mark in the test pattern as being approximately one pixel in size, in different embodiments each mark may occupy one or more pixels. Additionally, marks do not necessarily fall on even pixel boundaries and the controller 50 optionally interpolates between two or more template locations to identify the location of printed marks with sub-pixel precision.

As depicted in FIG. 3, the disjoint template 332 includes union of sets of two-dimensional arrangement of pixels where only a portion of the pixels that correspond to the expected arrangement of printed marks are evaluated in the convolution of the disjoint template with the scanned image data using a sliding window over the region where the printed marks are expected to be found. In FIG. 3, the disjoint template 332 includes 4 elements, each include a single pixel. These are pixels 342A-342D that correspond to the arrangement of the black ink marks 302A-302D, respectively. The controller 50 does not evaluate the remaining pixels in the disjoint template 332 to match the printed marks in the test pattern. The non-evaluated pixels are also referred to as "do not care" pixels.

During process 200, the controller 50 performs a sliding window alignment of the disjoint template with the image data and calculates the sum of the product of the disjoint template pixels and the scanned image reflectance pixels. When the disjoint template is aligned with the scanned image data then this sum is at a minimum. The point where the sum is at a minimum indicates a strong degree of similarity between the disjoint template and the scanned image data. As depicted in FIG. 3, the disjoint template 332 "moves" across the scanned image data of the test pattern 300 in the cross-process direction CP and in the process direction P as the controller evaluates the similarity between the disjoint template 332 and the scanned image data at different locations. In location 360, the pixels 342A-342C are offset from the image data of the corresponding marks 302A-302C in the cross-process direction CP. In location 362, the pixels 342A-342C are offset from the image data of the corresponding marks 302A-302C in the process direction P. In location 364, the pixels 342A-342C are aligned with the corresponding scanned image data of the marks 302A-302C, which corresponds to match between the disjoint template 332 and the scanned image data.

FIG. 3 depicts the disjoint template 332 as appearing to move for illustrative purposes. However, in different configurations the controller 50 "moves" the disjoint template or the scanned image data through modifications of memory addresses, array indexing, or other techniques that are known to the art to adjust the mapping between pixels in the disjoint template 332 and the scanned image data of the printed test pattern 300. As described below, the controller 50 applies an exhaustive or sparse template matching process to identify the absolute value of a difference between the disjoint template image data 68 and the scanned image data of the printed test pattern in a plurality of locations. The controller 50 identifies the location of the printed test pattern in the scanned image data with reference to a minimum sum of the absolute values of differences between the disjoint template and the scanned image data as corresponding to the location of the disjoint test pattern in the scanned image data.

One embodiment of a template matching process uses exhaustive pixel matching in which the controller 50 evaluates every pixel in the image data and a corresponding region of the scanned image data, including both pixels that correspond to the expected locations of printed marks in the test pattern and "do not care" pixel locations that do not influence the template matching process. The controller 50 identifies a sum of the absolute values of differences between corresponding pixels in a two-dimensional region of pixels of the scanned image data and pixels in the template image data 68. The controller 50 aligns the template image data with a reference pixel in the scanned image data at coordinates $(p_x, p_y)$. In one embodiment, the terms correspond to an alignment of the coordinate $(p_x, p_y)$ in the scanned image data with the upper-left hand corner pixel of the disjoint template 332. The following equation describes the metric that quantifies the alignment of the template and the image data that the controller 50 performs when the template and scanned image data are aligned in each location: $S(p_x, p_y)=\Sigma_{i=1}^{T_x}\Sigma_{j=1}^{T_y}|I_S(p_x+i, p_y+j)-I_T(i, j)|$. In the preceding equation, S represents the sum of the absolute values of differences between the scanned image data $(I_S)$ and the template $(I_T)$ when the template is aligned with the scanned image data at pixel coordinates $(p_x, p_y)$ where x corresponds to the cross-process direction and y corresponds to the process direction. In template matching, one uses the absolute difference because the gray level through the structure of the object being searched for is significant. The controller 50 processes every pixel in the overlapping two-dimensional region corresponding to the disjoint template image data and the corresponding scanned image data. Many pixels in the disjoint template image data, however, are "do not care" pixels that do not correspond to the location of any printed mark. The controller 50 identifies the do not care pixels and only generates the total sum of the differences between the disjoint template data and the scanned image data using pixels that correspond to the expected locations of the marks in the disjoint test pattern.

In a disjoint embodiment of the template matching process, the controller 50 also identifies a sum of the absolute values of differences between the pixel values of the scanned image data and corresponding template image data values from reference coordinates $(p_x, p_y)$. A disjoint template matching operation is more computationally efficient than the standard template matching process because the controller 50 only processes set of pixel coordinates that correspond to locations of marks in the disjoint template image data 68 without processing any of the remaining pixels in the region of the scanned image data that includes the printed test pattern.

In the disjoint template matching process, the controller 50 generates a list of the x and y coordinates for marks in the disjoint template data 68 and identifies the absolute value of the difference between the disjoint template and the scanned image data relative to the alignment coordinates $(p_x, p_y)$ at only the locations that are specified in the list. The controller 50 translates the disjoint template across the scanned image data and identifies the location of the test pattern where the sum of the absolute values of differences between the disjoint template and the scanned image data has a minimum value. The following equation describes the disjoint template matching process: $S(p_x, p_y)=\Sigma_{i=1}^{n_e}\Sigma_{j=1}^{n_p(i)}|I_S(p_x+x_{ij}, p_y+y_{ij})-I_T(x_{ij}, y_{ij})|$. In the preceding equation, $n_e$ is the number of elements in the disjoint template and the controller 50 uses the number i as an index into the list of locations for marks in the disjoint template image data 68. For the example in FIG. 3, the value of $n_e$ is 4 corresponding to four locations 342A-342D. The term $n_p(i)$ refers to the number of pixels or a dimension of a pixel array that the controller 50 processes around the coordinates corresponding to the ith element in the disjoint template. For the example in FIG. 3, there is only a single pixel for each of the 4 elements. In other embodiments, however, the controller 50 identifies the absolute value of differences between a plurality of pixels in the scanned image data and template image data in a single region corresponding to one mark. The terms $x_{ij}$ and $y_{ij}$ refer to the offset of the $j^{th}$ pixel of the $i^{th}$ element with reference to a fixed reference point for the print head corresponding to the particular disjoint template. Those having skill in the art will recognize that practical embodiments of the controller 50 use a zero-index (n=0 . . . 3 and j=0 . . . 2) instead of the illustrative 1 . . . 4 index. During the disjoint template matching process, the controller 50 generates the sum that only includes the selected pixels in the disjoint template that correspond to the expected locations of the printed marks in the scanned image data.

As described above, in the disjoint template matching process, the controller 50 compares a single pixel or optionally a plurality of pixels in the disjoint template image data to a corresponding location in the scanned image data. For example, the controller identifies the sum of the absolute value differences of a 3×3 or 4×4 pixel grid that is centered on the coordinates of a mark in the disjoint template image data 68 to a corresponding region in the scanned image data. The larger area of comparison enables the controller 50 to identify printed marks in situations where the positions of the marks may vary, such as in a three-dimensional object printer where the location of printed marks varies based on a distance between the printhead and an image receiving surface.

During the exhaustive disjoint template matching process identifies and ignores "do not care" pixels, but the identification of the do not care pixels consumes processing time while the sparse disjoint template matching process only requires the controller 50 to process the pixel locations that correspond to expected locations of marks in the disjoint template image data 68. Different embodiments of the process 200 use either the exhaustive or disjoint template matching processes to identify the sum of absolute difference values S over a range of locations as the controller 50 moves the disjoint template data to different locations in the scanned image data. The controller 50 identifies the pixel coordinates $(p_x, p_y)$ where the magnitude of the value of S is a minimum, which corresponds to the location with the greatest similarity between the disjoint template and the scanned image data.

During process 200, the controller 50 performs the exhaustive or disjoint template matching processes to match a disjoint template corresponding to most or all of the marks formed by a single printhead in the test pattern.

Figure 6:
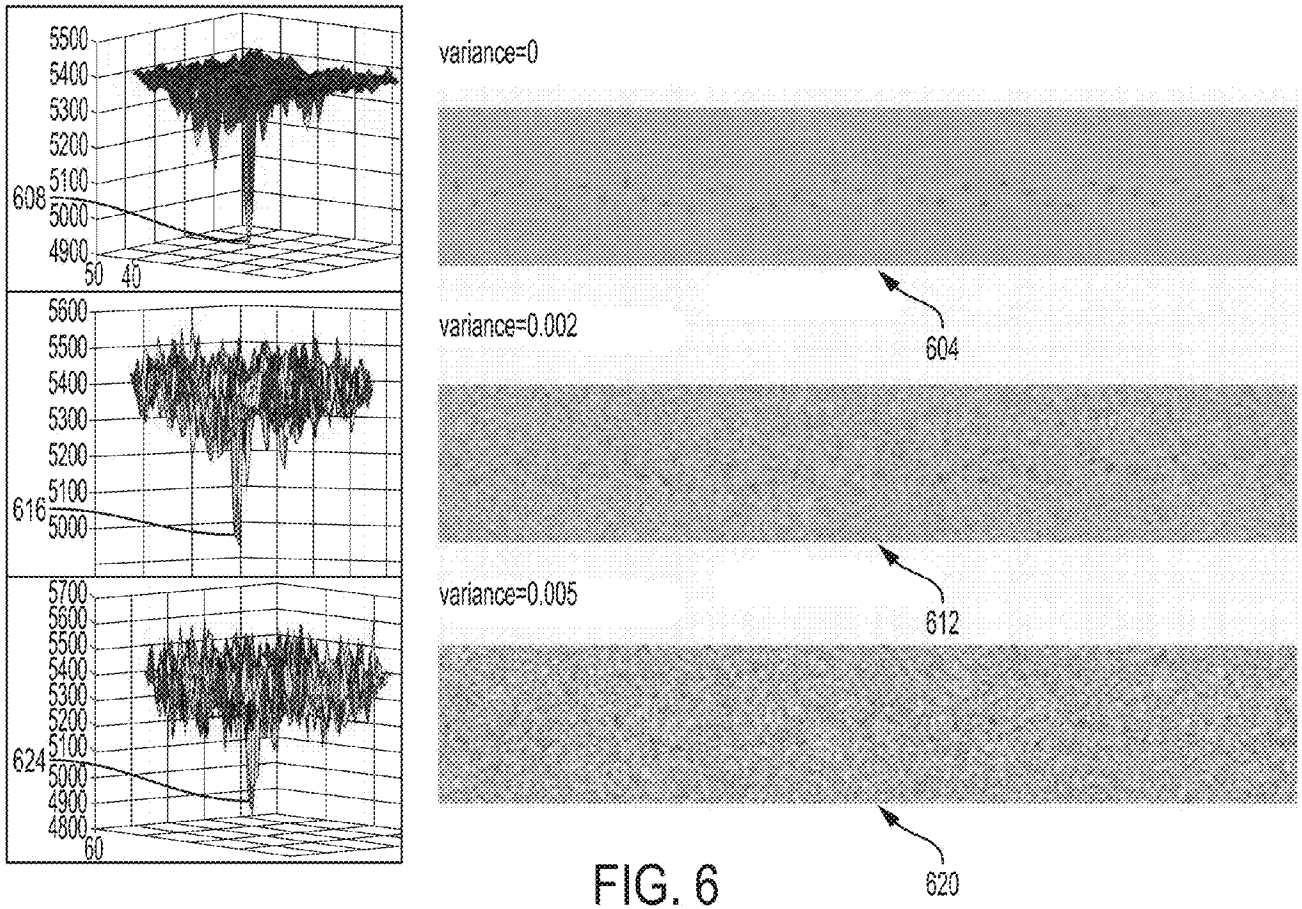
FIG. 6 is a depiction of sets of scanned image data corresponding to printed test patterns and image receiving surfaces with varying degrees of optical noise and corresponding template matching results for each set of scanned image data.

FIG. 3 depicts a simplified pattern with a small number of marks, but some printhead embodiments form test patterns that include a large number of marks. FIG. 3 also depicts a pattern where there is only a single mark at each location in the cross process direction. For low contrast inks, a stronger response may occur when multiple marks are printed from either a single ejector or multiple neighboring ejectors in the process direction. The spacing between drops in the process direction is matched to the disjoint template so that there is a strong response only when there is an exact alignment. In some instances, the match between the disjoint template and the printed marks is not exact due to random errors in the placement of marks, inoperable inkjets, and other image artifacts. However, the process 200 evaluates the entire template with the scanned image data. Consequently, the printer 5 still identifies the location of a printed group of marks that correspond to the disjoint template with a high degree of precision even when a portion of the printed marks in the test pattern are in the incorrect location or do not appear in the scanned image data. For example, FIG. 6 depicts a section of the scanned image data where it is required to determine the offset between the intended position of the printhead and the actual position of the printhead on a media that has different levels of intrinsic reflectance variation. For ink that has high contrast with the media, this situation might occur when marking on a specialty substrate such as nonwhite packing material. For ink that has low contrast with the media, the local variations of the substrate reflectance due to surface roughness or paper fibers may be on the same order or even larger than the contrast of the ink with the substrate The scanned image data 604 exhibits very low noise with a corresponding template match 608. The scanned image data samples 612 and 620 exhibit increasing levels of noise, however, which makes the identification of a single mark in a sparse test pattern more difficult due to artifacts in the noisy image data. However, as depicted in FIG. 6 the process 200 performs disjoint template matching for the entire portion of the test pattern that is formed by a single printhead, and the printer 5 accurately identifies the location of the printed marks in the test pattern at references 616 and 624 for the scanned image data 612 and 620, respectively.

Referring again to FIG. 2, the process 200 continues as the controller 50 identifies a spatial relationship between the printhead that ejects the marking agent to form the identified marks in the scanned image data and the image receiving surface (block 220). The spatial relationship refers to any aspect of the relative position of the printhead in relation to the image receiving surface that affects the location of the printed marks on the image receiving surface. In some instances the controller 50 identifies the spatial relationship of the printhead based on an absolute reference, such as an edge of the image receiving surface or a fiducial mark that is formed on the image receiving surface in a predetermined location. In other instances, the controller 50 identifies the spatial relationship based on the relative location of the printhead with reference to the locations of other marks in the test pattern from the other printheads in the print zone 20. For example, in the printer 5 the controller 50 identifies the location of the printhead with reference to the identified location of the printed marks in the scanned image data to identify the cross-process direction and process direction registration of the printhead in the print zone 20. Since the printed marks from the printhead occupy a two-dimensional region in the scanned image data, in one embodiment the controller 50 identifies the location of the printhead as the center of the two-dimensional region corresponding to the identified location of the match between the disjoint template and the scanned image data.

The process 200 continues with template matching between predetermined templates that correspond to each of the printheads that form the test pattern and the scanned image data as described above with reference to the processing of blocks 216 and 220 (block 224). The controller 50 optionally performs the disjoint template matching process for two or more printheads in parallel. In the printer 5, the controller 50 optionally performs a printhead registration process for one or more printheads in the print zone with identified cross-process direction or process direction locations that are outside of a predetermined tolerance range (block 228). To correct cross-process direction registration errors, the controller 50 activates one or more electromechanical actuators to adjust the positions of printheads to return the printheads to proper registration. To correct process direction registration errors, the controller 50 adjusts the timing of the generation of firing signals for a printhead, which either moves the location of printed marks upstream or downstream in the process direction to correct the registration error.

While the FIG. 2 describes the process 200 in conjunction with the inkjet printer of FIG. 1 for illustrative purposes, alternative printer embodiments that include two or more printhead marking devices are also suitable for use with the process 200. For example, the process 200 is compatible with indirect inkjet printers that form latent ink images on indirect image receiving members and three-dimensional object printers that use two or more printheads to form a three-dimensional object from a plurality of layers of printed material. These printer embodiments form interleaved sparse test patterns using two or more printheads and analyze scanned image data of the interleaved test patterns as described above in process 200 to identify the relative registration of printheads during a printhead registration process. The disjoint template matching process 200 enables a controller to identify printed patterns of both high contrast color inks (e.g. CMYK inks) and lower-contrast marking agents such as transparent inks or build materials that produce a lower optical contrast against the image receiving surface in the scanned image data. Other printer embodiments that are compatible with the process 200 include, but are not necessarily limited to, xerographic printers, LED printers, and thermal printers that include multiple marking devices. These printers identify the relative locations of one or more of the marking devices in relation to each other and to the image receiving surface to maintain proper registration during operation.

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A method of marking device registration in a printer comprising:

operating with a controller a first marking device to form a first plurality of marks in a test pattern on an image receiving surface;

operating with the controller a second marking device to form a second plurality of marks in the test pattern on the image receiving surface;

generating with an optical sensor image data of the test pattern formed on the image receiving surface;

retrieving with the controller a first disjoint template corresponding to an arrangement of the first plurality of marks in the test pattern from a memory;

identifying with the controller a location of the first disjoint template in alignment with only the first plurality of marks in the image data and not with the second plurality of marks in the image data; and identifying with the controller a spatial relationship between the first marking device and the image receiving surface with reference to the location of the first disjoint template in the image data.

2. The method of claim 1, the operation of the first marking device and the second marking device further comprising:

operating a first plurality of ejectors in a first printhead to eject a first plurality of ink drops to form the first plurality of marks on the image receiving surface; and operating a second plurality of ejectors in a second printhead to eject a second plurality of ink drops to form the second plurality of marks on the image receiving surface.

3. The method of claim 2 the operation of the plurality of ejectors further comprising:

operating with the controller the first plurality of ejectors in the first printhead to form the first plurality of printed marks arranged along a cross-process direction with a first predetermined distance in the cross-process direction between adjacent marks in the first plurality of marks.

4. The method of claim 3, the operation of the plurality of ejectors further comprising:

operating with the controller the first plurality of ejectors in the first printhead at predetermined times to produce the first plurality of marks with at least one mark in the first plurality of marks being offset in a process direction from at least one other mark in the first plurality of marks.

5. The method of claim 3, the operation of the plurality of ejectors further comprising:

operating with the controller each ejector in the first plurality of ejectors in the first printhead to eject only a single drop of the marking agent to form one mark in the first plurality of marks.

6. The method of claim 2 further comprising:

retrieving with the controller a second disjoint template corresponding to an arrangement of the second plurality of marks in the test pattern from the memory;

identifying with the controller a location of the second disjoint template in alignment with only the second plurality of marks in the image data and not with the first plurality of marks in the image data; and identifying with the controller the spatial relationship between the second printhead and the image receiving surface with reference to the identified location of the second disjoint template in the image data.

7. The method of claim 6, the operation of the second printhead further comprising:

operating with the controller the second plurality of ejectors in the second printhead to form the second plurality of printed marks arranged along the cross-process direction with the first predetermined distance in the cross-process direction between adjacent marks in the second plurality of marks.

8. The method of claim 7, the operation of the plurality of ejectors in the first printhead and the second printhead further comprising:

operating with the controller a portion of the plurality of ejectors in the first printhead to produce the arrangement of the first plurality of marks with a first plurality of offsets in a process direction; and operating with the controller a portion of the plurality of ejectors in the second printhead to produce the arrangement of the second plurality of marks with a second plurality of offsets in the process direction, a first mark formed in the first plurality of marks having a process direction offset that is different from another process direction offset of a second mark in the second plurality of marks that is adjacent to the first mark in the test pattern.

9. The method of claim 1, the operation of the first marking device and the second marking device further comprising:

operating a first light source to illuminate a first portion of the charged image receiving surface corresponding to locations of the first plurality of marks;

operating a second light source to illuminate a second portion of the charged image receiving surface corresponding to locations of the second plurality of marks; and operating at least one toner development subsystem to deposit at least one type of toner on the first plurality of locations and the second plurality of locations to form the first plurality of marks and the second plurality of marks.

10. The method of claim 1, the identification of the location of the first disjoint template in the image data further comprising:

aligning with the controller the first disjoint template with the image data in a plurality of locations in the image data;

identifying with the controller a plurality of differences between pixel values of a first predetermined arrangement of pixels in the first disjoint template corresponding to the first plurality of marks in the test pattern and a corresponding second arrangement of pixels in the image data for each location in the plurality of locations;

identifying with the controller a plurality of sums, each sum in the plurality of sums corresponding to a sum of the plurality of differences for one location in the plurality of locations; and identifying with the controller the location of the first disjoint template corresponding to the first plurality of marks in the image data with reference to one location in the plurality of locations of alignment between the first disjoint template and the image data corresponding to one sum in the plurality of sums having a minimum value.

11. The method of claim 10, the identification of the plurality of differences with the first disjoint template being aligned with the image data in one location in the plurality of locations further comprising:

retrieving with the controller a plurality of pixel coordinates corresponding to locations of only the first predetermined arrangement of pixels in the first disjoint template; and identifying with the controller one sum in the plurality of sums with reference to a plurality of differences between the first disjoint template at only the plurality of pixel coordinates retrieved from the memory and the image data.

12. The method of claim 1, the operation of the first and second marking devices further comprising:

operating with the controller the first marking device and the second marking device to form the first plurality of marks in the test pattern in an interleaved arrangement with the second plurality of marks in the test pattern on the image receiving surface.

13. An inkjet printer comprising:

a first printhead including a first plurality of ejectors configured to eject drops of a marking agent onto an image receiving surface in a print zone;

a second printhead including a second plurality of ejectors configured to eject drops of the marking agent onto the image receiving surface in the print zone;

an optical sensor configured to generate image data of the image receiving surface in the print zone; and a controller operatively connected to the first printhead, the second printhead, the optical sensor, and a memory, the controller being configured to:

operate the first plurality of ejectors in the first printhead to form a first plurality of marks in a test pattern on an image receiving surface;

operate the second plurality of ejectors in the second printhead to form a second plurality of marks in the test pattern on the image receiving surface;

generate with the optical sensor image data of the test pattern formed on the image receiving surface;

retrieve a first disjoint template corresponding to an arrangement of the first plurality of marks in the test pattern from the memory;

identify a location of the first disjoint template in alignment with only the first plurality of marks in the image data and not with the second plurality of marks in the image data; and identify a spatial relationship between the first marking printhead and the image receiving surface with reference to the location of the first disjoint template in the image data.

14. The printer of claim 13, the controller being further configured to:

operate the first plurality of ejectors in the first printhead to form the first plurality of printed marks arranged along a cross-process direction with a first predetermined distance in the cross-process direction between adjacent marks in the first plurality of marks.

15. The printer of claim 14, the controller being further configured to:

operate the first plurality of ejectors in the first printhead at predetermined times to produce the first plurality of marks with at least one mark in the first plurality of marks being offset in a process direction from at least one other mark in the first plurality of marks.

16. The printer of claim 14, the controller being further configured to:

operate each ejector in the first plurality of ejectors in the first printhead to eject only a single drop of the marking agent to form one mark in the first plurality of marks.

17. The printer of claim 13, the controller being further configured to:

retrieve a second disjoint template corresponding to an arrangement of the second plurality of marks in the test pattern from the memory;

identify a location of the second disjoint template in alignment with only the second plurality of marks in the image data and not with the first plurality of marks in the image data; and identify the spatial relationship between the second printhead and the image receiving surface with reference to the identified location of the second disjoint template in the image data.

18. The printer of claim 13, the controller being further configured to: operate the second plurality of ejectors in the second printhead to form the second plurality of printed marks arranged along the cross-process direction with a first predetermined distance in the cross-process direction between adjacent marks in the second plurality of marks.

19. The printer of claim 13, the controller being further configured to operate a portion of the plurality of ejectors in the first printhead to produce the arrangement of the first plurality of marks with a first plurality of offsets in a process direction; and operate the portion of the plurality of ejectors in the second printhead to produce the arrangement of the second plurality of marks with a second plurality of offsets in the process direction, a first mark formed in the first plurality of marks having a process direction offset that is different from another process direction offset of a second mark in the second plurality of marks that is adjacent to the first mark in the test pattern.

20. The printer of claim 13, the controller being further configured to:

align the first disjoint template with the image data in a plurality of locations in the image data;

identify a plurality of differences between pixel values of a first predetermined arrangement of pixels in the first disjoint template corresponding to the first plurality of marks in the test pattern and a corresponding second arrangement of pixels in the image data for each location in the plurality of locations;

identify a plurality of sums, each sum in the plurality of sums corresponding to a sum of the plurality of differences for one location in the plurality of locations; and identify the location of the first disjoint template corresponding to the first plurality of marks in the image data with reference to one location in the plurality of locations of alignment between the first disjoint template and the image data corresponding to one sum in the plurality of sums having a minimum value.

21. The printer of claim 20, the controller being further configured to:

retrieve a plurality of pixel coordinates corresponding to locations of only the first predetermined arrangement of pixels in the first disjoint template; and identify one sum in the plurality of sums with reference to a plurality of differences between the first disjoint template at only the plurality of pixel coordinates retrieved from the memory and the image data.

22. The printer of claim 13, the controller being further configured to:

operate the first plurality of inkjets and the second plurality of inkjets to form the first plurality of marks in an interleaved arrangement with the second plurality of marks in the test pattern.

* * * * *